US011227731B2

(12) United States Patent
Kuroki et al.

(10) Patent No.: US 11,227,731 B2
(45) **Date of Patent: *Jan. 18, 2022**

(54) SWITCH WITH GUIDE AND SLOPED FACES

(71) Applicant: OMRON Corporation, Kyoto (JP)

(72) Inventors: Kenji Kuroki, Suita (JP); Yuya Kudo, Otsu (JP); Kenji Takahama, Okayama (JP)

(73) Assignee: OMRON Corporation, Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/648,256

(22) PCT Filed: Oct. 12, 2018

(86) PCT No.: PCT/JP2018/038028
§ 371 (c)(1),
(2) Date: Mar. 18, 2020

(87) PCT Pub. No.: WO2019/078098
PCT Pub. Date: Apr. 25, 2019

(65) Prior Publication Data

US 2020/0243281 A1 Jul. 30, 2020

(30) Foreign Application Priority Data

Oct. 20, 2017 (JP) ..... JP2017-203842
Dec. 4, 2017 (JP) ..... JP2017-232313

(51) Int. Cl.
*H01H 13/14* (2006.01)
*H01H 13/06* (2006.01)
(Continued)

(52) U.S. Cl.
CPC ..... *H01H 13/14* (2013.01); *H01H 13/063* (2013.01); *H01H 13/10* (2013.01);
(Continued)

(58) Field of Classification Search
CPC ..... H01H 13/14; H01H 21/08; H01H 21/22; H01H 21/36; H01H 13/063; H01H 13/10;
(Continued)

(56) References Cited

U.S. PATENT DOCUMENTS 3,764,762 A * 10/1973 Roeser ..... H01H 13/12 200/521
5,187,056 A 2/1993 Saito et al.
(Continued)

FOREIGN PATENT DOCUMENTS

CN 104134563 A 11/2014
CN 111095460 A 5/2020
(Continued)

OTHER PUBLICATIONS

An English translation of the International Report("ISR") of PCT/JP2018/038028 dated Jan. 8, 2019.
(Continued)

*Primary Examiner* — Lheiren Mae A Caroc

(74) *Attorney, Agent, or Firm* — Metrolex IP Law Group, PLLC

(57) ABSTRACT

A switch includes a housing, a movable member reciprocable in a movement direction relative to the housing and including an operation part located at an end of the movable member outside the housing, and a guide that guides the movable member in the movement direction. The operation part has a plurality of slopes extending linearly from the operation surface toward a distal end of the movable member outside the housing, sloping away from a central axis of
(Continued)

the movable member toward the operation surface, and sloping in directions intersecting with one another as viewed in the movement direction.

5 Claims, 6 Drawing Sheets

(51) Int. Cl.
*H01H 13/10* (2006.01)
*H01H 21/08* (2006.01)
*H01H 21/22* (2006.01)
*H01H 21/36* (2006.01)

(52) U.S. Cl.
CPC ..... *H01H 21/08* (2013.01); *H01H 21/22* (2013.01); *H01H 21/36* (2013.01); *H01H 2221/058* (2013.01); *H01H 2221/088* (2013.01)

(58) Field of Classification Search
CPC ..... H01H 2221/088; H01H 2221/058; H01H 2221/026; G06F 3/0202; G06F 2/0219
USPC ..... 200/302.1–302.3, 341, 520, 17 R, 329, 200/344, 345, 521, 5 A, 5 R, 5 B, 5 C, 200/5 D, 5 E, 5 EA, 5 EB, 5 F, 16 R, 200/16 B, 16 C, 16 D, 16 E, 16 F, 18, 200/43.13, 43.18, 50.36, 51.16, 402, 200/405–409, 510, 522–537, 552, 314, 200/342, 343, 4, 6 A, 6 R; 400/490, 492
See application file for complete search history.

(56) References Cited

U.S. PATENT DOCUMENTS

| | | | | |
|---|---|---|---|---|
| 5,528,235 | A * | 6/1996 | Lin | G06F 3/0234 341/22 |
| 6,541,715 | B2 * | 4/2003 | Swanson | H01H 13/705 200/5 A |
| 7,745,744 | B2 * | 6/2010 | Nakase | H01H 25/008 200/6 A |
| 2017/0309420 | A1 | 10/2017 | Iwamoto | |
| 2020/0219681 | A1 * | 7/2020 | Kuroki | H01H 21/36 |
| 2020/0243281 | A1 | 7/2020 | Kuroki et al. | |

FOREIGN PATENT DOCUMENTS

| | | | | |
|---|---|---|---|---|
| DE | 4208088 | C1 * | 4/1993 | H01H 13/063 |
| JP | 4-085537 | * | 7/1992 | H01H 13/52 |
| JP | H04-85537 | U | 7/1992 | |
| JP | H09-213165 | A | 8/1997 | |
| JP | 2001-229767 | A | 8/2001 | |
| JP | 2006-331810 | A | 12/2006 | |
| JP | 2016-100202 | A | 5/2016 | |

OTHER PUBLICATIONS

The Written Opinion("WO") of PCT/JP2018/038028 dated Jan. 8, 2019.

The Office Action (CNOA) dated Jul. 5, 2021 in a counterpart Chinese patent application.

* cited by examiner

SWITCH WITH GUIDE AND SLOPED FACES

FIELD

The present disclosure relates to a switch.

BACKGROUND

Patent Literature 1 describes a switch device including a housing with a compartment, and an operation lever and a coil spring accommodated in the compartment. The operation lever attached to the housing in the switch device partially protrudes from the compartment, and is urged by the coil spring in the direction in which the operation lever protrudes from the compartment.

CITATION LIST

Patent Literature

Patent Literature 1: Japanese Unexamined Patent Application Publication No. 2001-229767

SUMMARY

Technical Problem

In the switch device, the operation lever is a substantially triangular flat plate having one vertex exposed from the compartment and two vertexes accommodated in the compartment, and is attached to the housing in a manner rotatable about one vertex of the triangle inside the compartment. The switch device may thus limit the operational direction of the operation lever to the rotation direction.

One or more aspects of the present disclosure are directed to a switch operable in multiple directions including directions other than a rotation direction about one vertex and having a lower likelihood of the operational direction being limited.

Solution to Problem

A switch according to one aspect of the disclosure includes a housing having an operation surface with an operation hole and an internal compartment communicating with outside through the operation hole, a movable member accommodated in the compartment and extending in a movement direction intersecting with the operation surface from the compartment to outside the housing through the operation hole, including an operation part located at an end of the movable member outside the housing, and reciprocable in the movement direction relative to the housing, and a guide that guides the movable member in the movement direction. The operation part has a plurality of slopes extending linearly from the operation surface toward a distal end of the movable member outside the housing, sloping away from a central axis extending in the movement direction of the movable member toward the operation surface, and sloping in directions intersecting with one another as viewed in the movement direction.

Advantageous Effects

In the switch according to the above aspect, the movable member includes the operation part located at an end outside the housing, and is reciprocable in the movement direction relative to the housing. The operation part has the multiple slopes sloping away from the central axis of the movable member toward the operation surface and sloping in the directions intersecting with one another as viewed in the movement direction. The switch with this structure allows the movable member to be operable in multiple directions about the central axis, and to have a lower likelihood of the operational direction being limited.

DETAILED DESCRIPTION

Embodiments of the present disclosure will now be described with reference to the accompanying drawings. The terms indicating specific directions or positions (e.g., up, down, right, and left) used herein as appropriate are for easy understanding of the present disclosure with reference to the drawings, and do not limit the technical scope of the present disclosure. The embodiments described below are mere examples and do not limit the scope of the present disclosure and its applications or use. The drawings are only schematic and may not be drawn to scale relative to the actual size of each component.

Figure 1:
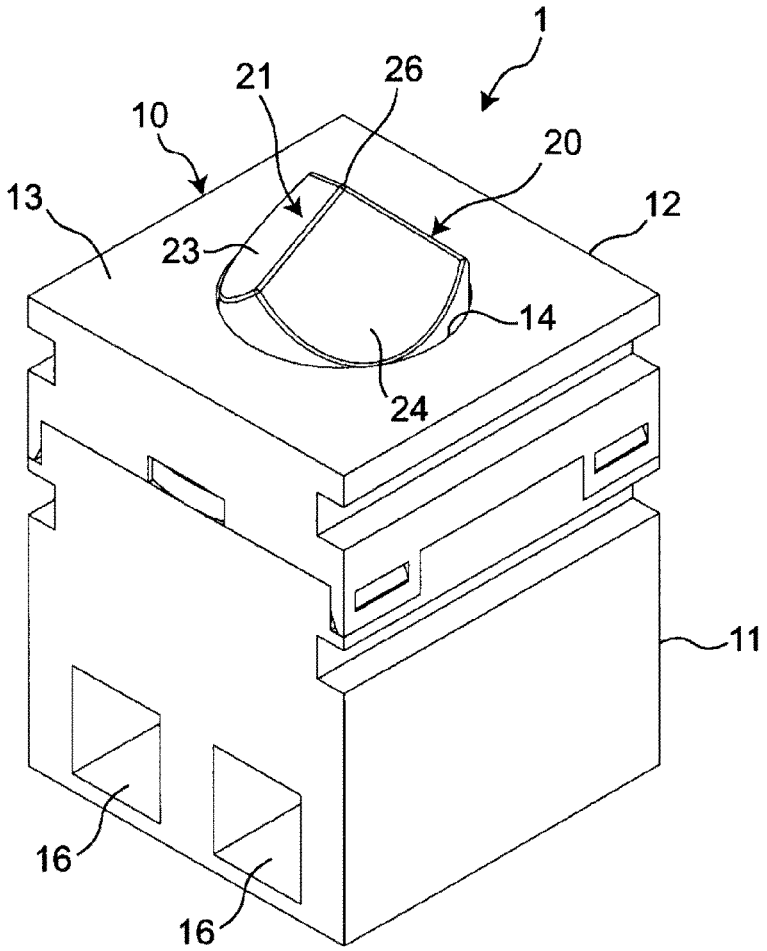
FIG. 1 is a perspective view of an example switch according to an embodiment of the present disclosure.
Figure 2:
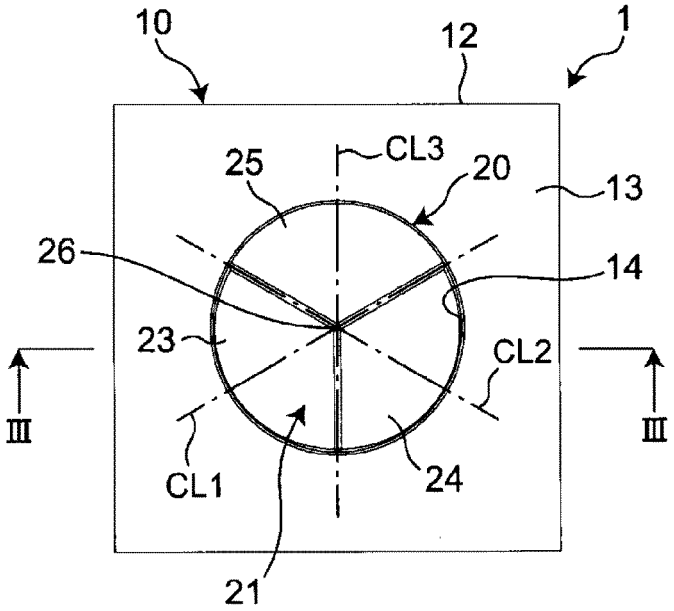
FIG. 2 is a plan view of the switch in FIG. 1.

As shown in FIGS. 1 and 2, a switch 1 according to an embodiment of the present disclosure includes a housing 10 and a movable member 20 accommodated in the housing 10.

Figure 3:
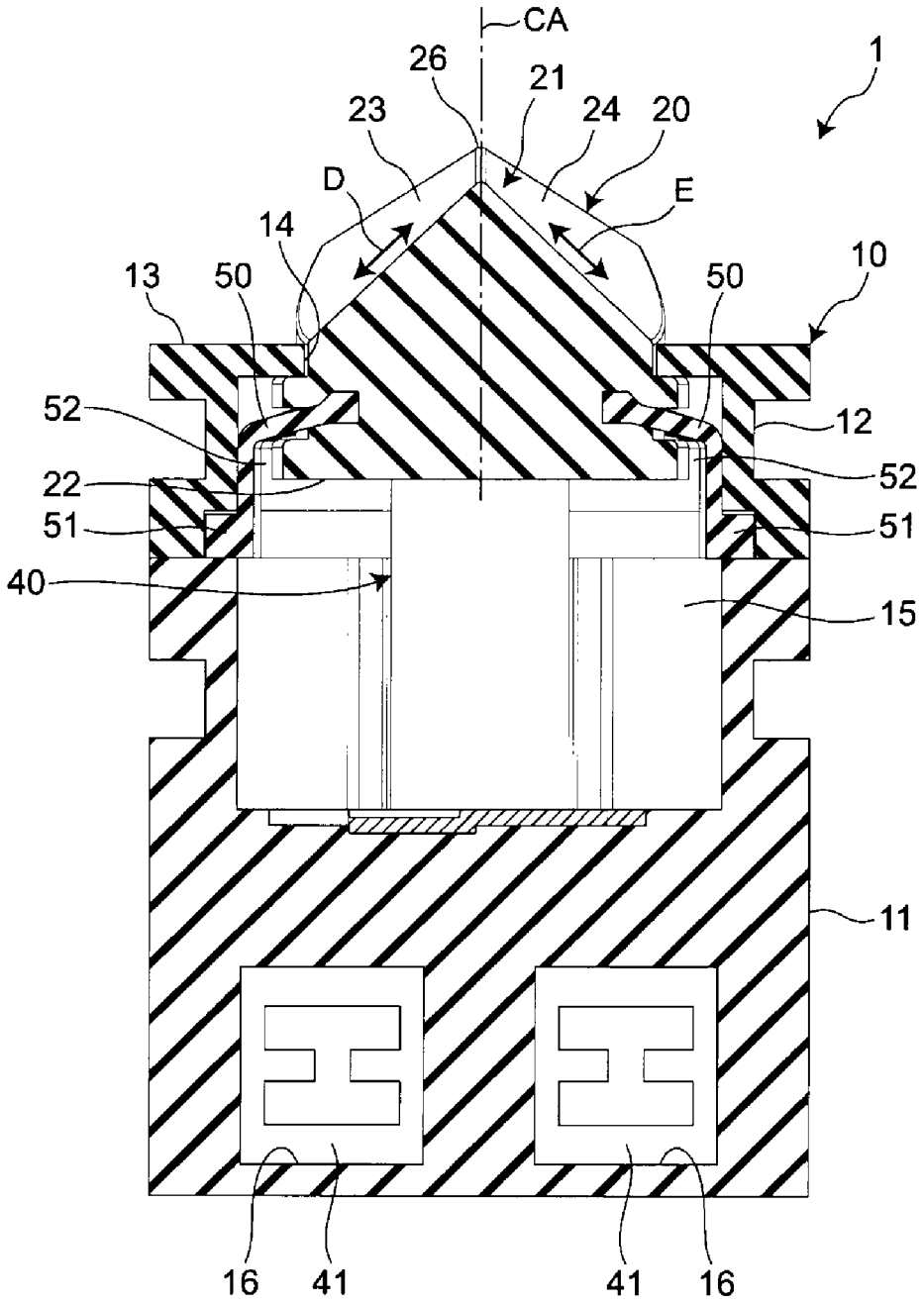
FIG. 3 is a cross-sectional view taken along line III-III in FIG. 2.

The housing 10 has an operation surface 13 with an operation hole 14 and further has an internal compartment 15 (shown in FIG. 3). The movable member 20 accommodated in the compartment 15 in the housing 10 is partially exposed outside the housing 10 through the operation hole 14. The movable member 20 is located in a manner reciprocable relative to the housing 10 in a movement direction intersecting with (e.g., orthogonal to) the operation surface 13 through the operation hole 14. The reciprocation of the movable member 20 activates or deactivates a contact mechanism 40 (shown in FIG. 3) inside the housing 10 to turn on or off the switch 1.

Figure 4:
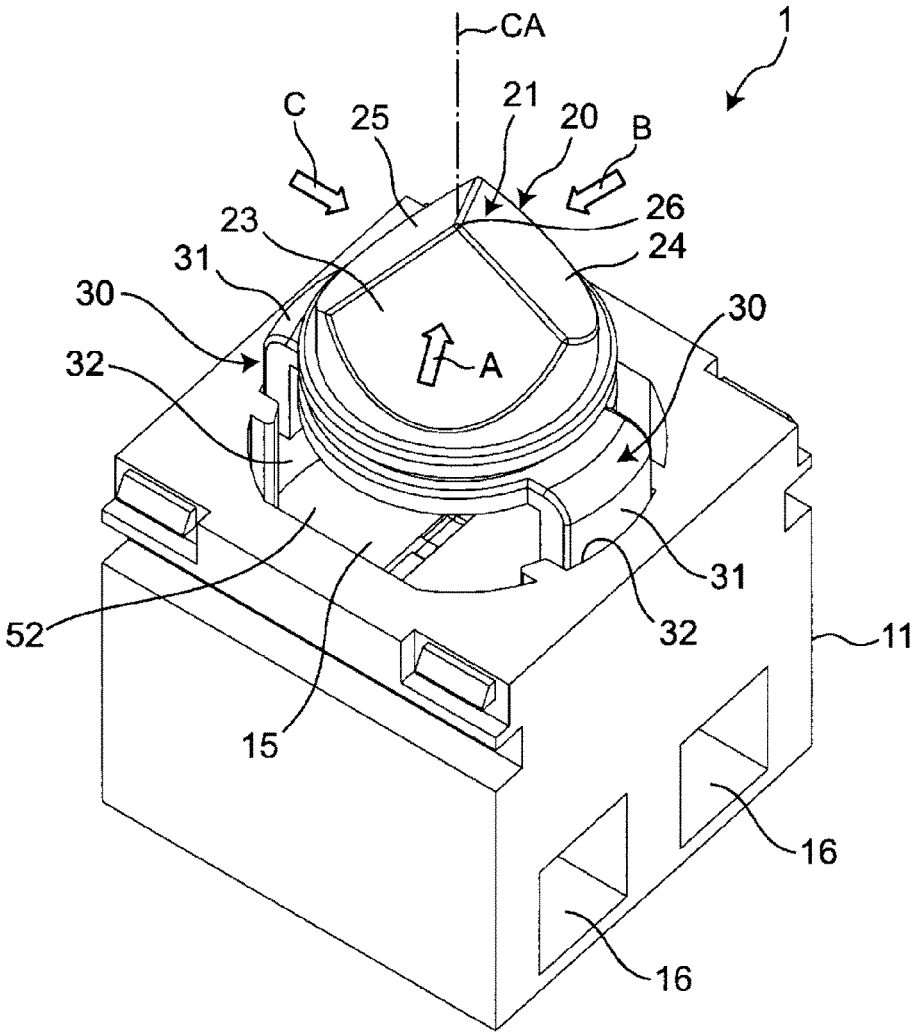
FIG. 4 is a perspective view of the switch in FIG. 1 excluding a cover and a sealant.

As shown in FIG. 4, the switch 1 includes guides 30 for guiding the movable member 20 in the movement direction. The guides 30 are located inside the compartment 15. In FIG. 4, a cover 12, the contact mechanism 40, and a sealant 50 (described later) in the housing 10 are not shown.

The components of the switch 1 will now be described.

As shown in FIG. 1, the housing 10 includes a case 11, which is a substantially rectangular box, and the cover 12. As shown in FIG. 3, the housing 10 has the internal compartment 15 defined by the case 11 and the cover 12.

As shown in FIG. 1, the case 11 has two through-holes 16 extending through a pair of facing side surfaces below the compartment 15. As shown in FIG. 3, the through-holes 16 partially receive a pair of terminals 41 (described later) to allow connection of, for example, a conductive portion of a wire (not shown) placed in each through-hole 16 to the corresponding terminal 41.

As shown in FIGS. 1 and 2, the cover 12 has an upper surface serving as the operation surface 13, and the circular operation hole 14 at the substantial center of the operation surface 13. The compartment 15 inside the housing 10 communicates with the outside of the housing 10 through the operation hole 14.

As shown in FIG. 3, the movable member 20 extends from inside the compartment 15 to outside the housing 10 through the operation hole 14 in the movement direction (specifically, in the vertical direction in FIG. 3). The movable member 20 includes, at its end outside the housing 10, an operation part 21 exposed outside the housing 10. The movable member 20 also has, at its end adjacent to the compartment 15, a working surface 22 facing and being partially in contact with the contact mechanism 40.

The contact mechanism 40 is electrically connected to the pair of terminals 41 located electrically independent of each other, and urges the movable member 20 toward outside the housing 10 in the movement direction.

As shown in FIGS. 1 and 2, the operation part 21 is a substantially triangular pyramid, and has multiple (three in the present embodiment) slopes 23, 24, and 25 each serving as a pyramidal face. The slopes 23, 24, and 25 extend linearly from the operation surface 13 toward a distal end 26 of the movable member 20 outside the housing 10, slope toward a central axis CA extending in the movement direction of the movable member 20 away from the operation surface 13, and slope in directions intersecting with one another as viewed in the movement direction about the central axis CA. The sloping directions refer to the direction along the slopes 23, 24, and 25. Examples are shown in FIG. 3. In FIG. 3, arrow D indicates an example sloping direction of the slope 23, and arrow E indicates another example sloping direction of the slope 24.

More specifically, the slopes 23, 24, and 25 are sectors each having a central angle of about 120 degrees. The three slopes 23, 24, and 25 define the outer surface (pyramidal faces) of the operation part 21. When the slope 23 is a first slope 23 and the slopes 24 and 25 adjacent to the first slope 23 about the central axis CA are a second slope 24 and a third slope 25, the second slope 24 and the third slope 25 have their center lines CL2 and CL3 located each at an angle of about 120 degrees about the central axis CA with respect to a center line CL1 of the first slope 23. Thus, the second slope 24 and the third slope 25 are adjacent to the first slope 23 about the central axis CA, and are located within an angle of less than 180 degrees (120 degrees in the present embodiment) about the central axis CA with respect to the first slope 23.

As shown in FIG. 4, the guide 30 is located on at least one side of the movable member 20 in an operational direction (specifically, the direction intersecting with the central axis CA of the movable member 20) intersecting with the movement direction of the movable member 20 (specifically, the direction along the central axis CA).

More specifically, each guide 30 has a protrusion 31 on one of the housing 10 and the movable member 20 and a groove 32 on the other of the housing 10 and the movable member 20. The protrusion 31 protrudes in the operational direction and is elongated in the movement direction. The groove 32 extends in the movement direction to receive the protrusion 31 and guide the received protrusion 31 in the movement direction.

In the present embodiment, arrows A to C in FIG. 4 indicate the operational directions, and the guides 30 are located on both sides of the movable member 20 in the operational directions A to C with respect to the movable member 20. The protrusions 31 are arranged symmetrical to each other with respect to the central axis CA on the radially outer surface of the movable member 20 with respect to the central axis CA. The grooves 32 are arranged symmetrical to each other with respect to the central axis CA on the inner peripheral surface of the housing 10 in the operational direction defining the compartment 15.

As shown in FIG. 3, the switch 1 further includes the sealant 50 sealing a gap 52 between the movable member 20 and the housing 10 inside the compartment 15.

The sealant 50 is tubular and has openings at its two ends in the movement direction. The sealant 50 is formed from an insulating resin such as rubber. The movable member 20 is fitted in the upper opening in the sealant 50, which covers the outer peripheral surface of the movable member 20 between the operation part 21 and the working surface 22. The upper end of the sealant 50 thus reciprocates in the movement direction as the movable member 20 reciprocates. The sealant 50 has, at its lower end, a flange 51 protruding radially outward with respect to the central axis CA and extending along the entire periphery. The flange 51 is held between the case 11 and the cover 12 of the housing 10.

The operation of the switch 1 will now be described.

For example, when an external force is applied to the first slope 23 of the operation part 21 in the operational direction A shown in FIG. 4, the external force presses the movable member 20 in the operational direction A and toward the inside of the compartment 15.

Thus, when an external force is applied to the operation part 21 of the movable member 20 in the operational direction, the movable member 20 is depressed toward the compartment 15 against the urging force from the contact mechanism 40, and is guided by the guides 30 from outside the housing 10 into the compartment 15 along the central axis CA (in the movement direction). The pair of terminals 41 are thus electrically connected with each other, and the switch 1, which has been off, is turned on.

When the external force applied to the operation part 21 is released, the movable member 20 is urged by the contact mechanism 40 from the compartment 15 in the housing 10 toward outside the housing 10, and is guided by the guides 30 from the compartment 15 toward outside the housing 10 in the movement direction. The pair of terminals 41 are thus electrically disconnected from each other, and the switch 1, which has been on, is turned off.

The switch 1 is operated when an external force is applied to the first slope 23 of the operation part 21 in the operational direction A shown in FIG. 4 in the above embodiment. However, the switch 1 is operable in the same manner when an external force is applied to the second slope 24 of the operation part 21 in the operational direction B or to the third slope 25 in the operational direction C shown in FIG. 4. The switch 1 can thus be turned on or off by an operation performed in multiple directions.

In the switch 1, the movable member 20 includes the operation part 21 located at the end outside the housing 10, and is reciprocable in the movement direction relative to the housing 10. The operation part 21 has the multiple slopes 23, 24, and 25 sloping away from the central axis CA of the movable member 20 toward the operation surface 13 and sloping in the directions intersecting with one another as viewed in the movement direction. The multiple slopes 23, 24, and 25 allow the movable member 20 to be operable in multiple directions about the central axis CA. The switch 1 thus has a lower likelihood of the operational direction being limited.

The slopes 23, 24, and 25 extend linearly from the operation surface 13 toward the distal end 26 of the movable member 20 outside the housing 10. This structure allows the slope angles of the slopes 23, 24, and 25 with respect to the operation surface 13 to be adjusted more easily than, for example, the slope angle of a movable member having a peripheral surface standing upward from the operation surface 13 toward outside the housing 10 in a direction perpendicular to the operation surface 13. The external force applied in the operational direction is thus easily transmitted in the movement direction. This improves the operability of the switch 1.

The slopes 23, 24, and 25 may have a slope angle of 1 to 60 degrees with respect to the operation surface 13. When the slope angle is less than one degree, an external force is difficult to apply to the slopes 23, 24, and 25 in the operational direction. When the slope angle is more than 60 degrees, an external force applied in the operational direction is difficult to transmit in the movement direction. When, for example, extending outward from the housing 10 curvedly rather than linearly, the slopes 23, 24, and 25 slope at more than 60 degrees near the operation surface 13. This may lower the operability of the switch 1.

The multiple slopes include the first slope 23 and the second slope 24. The second slope 24 is adjacent to the first slope 23 about the central axis CA and is located within an angle of less than 180 degrees about the central axis CA with respect to the first slope 23. The movable member 20 is more reliably operable in multiple three-dimensional directions. The switch 1 thus has a lower likelihood of the operational direction being limited.

Each guide 30 has the protrusion 31 located on one of the housing 10 and the movable member 20, protruding in the operational direction, and elongated in the movement direction and the groove 32 located on the other of the housing 10 and the movable member 20, extending in the movement direction, receiving the protrusion 31, and guiding the received protrusion 31 in the movement direction. The guides 30 thus guide the movable member 20 in the movement direction more reliably. The switch 1 thus has higher operability.

The switch 1 further includes the sealant 50 sealing the gap 52 between the movable member 20 and the housing 10 inside the compartment 15. The sealant 50 can protect the contact mechanism 40 from fluid such as water entering the compartment 15 through the operation hole 14 in the operation surface 13.

The multiple slopes are not limited to the three slopes 23, 24, and 25 of the operation part 21 in the switch 1, and may simply slope toward the central axis CA of the movable member 20 away from the operation surface 13 and slope in the directions intersecting with one another as viewed in the movement direction.

Figure 5:
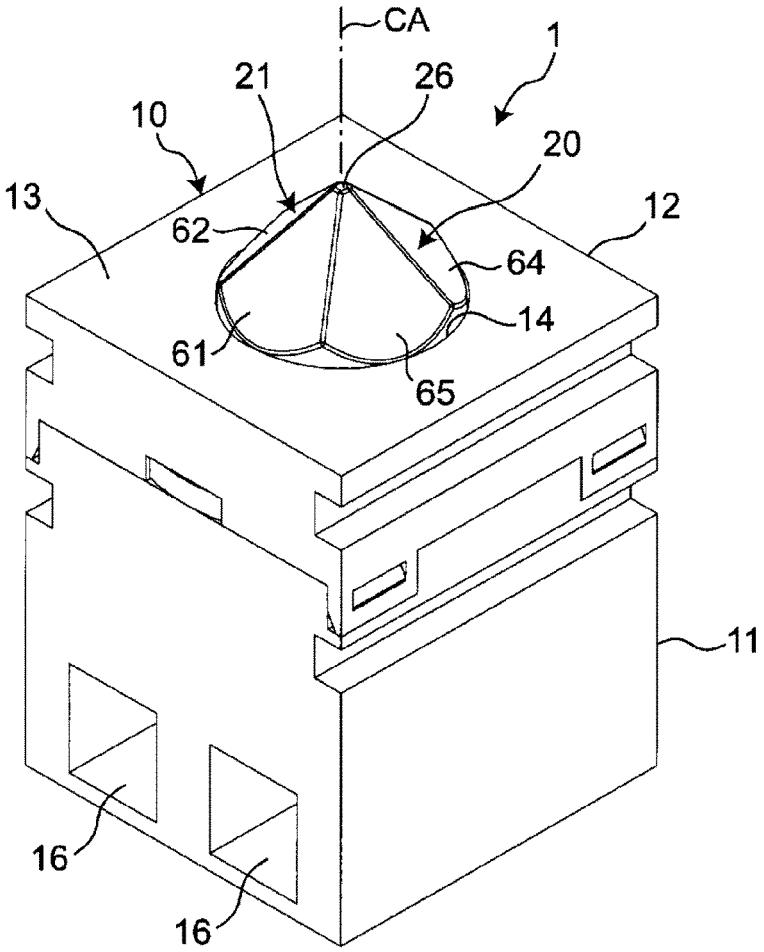
FIG. 5 is a perspective view of a switch according to a first modification of the switch in FIG. 1.
Figure 6:
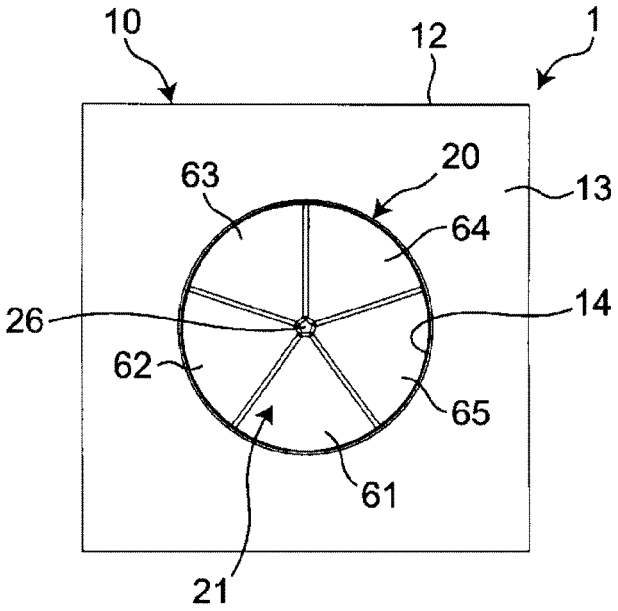
FIG. 6 is a plan view of the switch in FIG. 5.

As shown in FIGS. 5 and 6, for example, the operation part 21 may have five slopes 61, 62, 63, 64, and 65. In this case, the slopes 61, 62, 63, 64, and 65 are sectors each having a central angle of about 72 degrees. The five slopes 61, 62, 63, 64, and 65 define the outer surface of the operation part 21. Slopes (e.g., the slopes 62 and 65) adjacent to one slope (e.g., the slope 61) may be located within an angle of less than 180 degrees about the central axis CA with respect to that slope.

Figure 7:
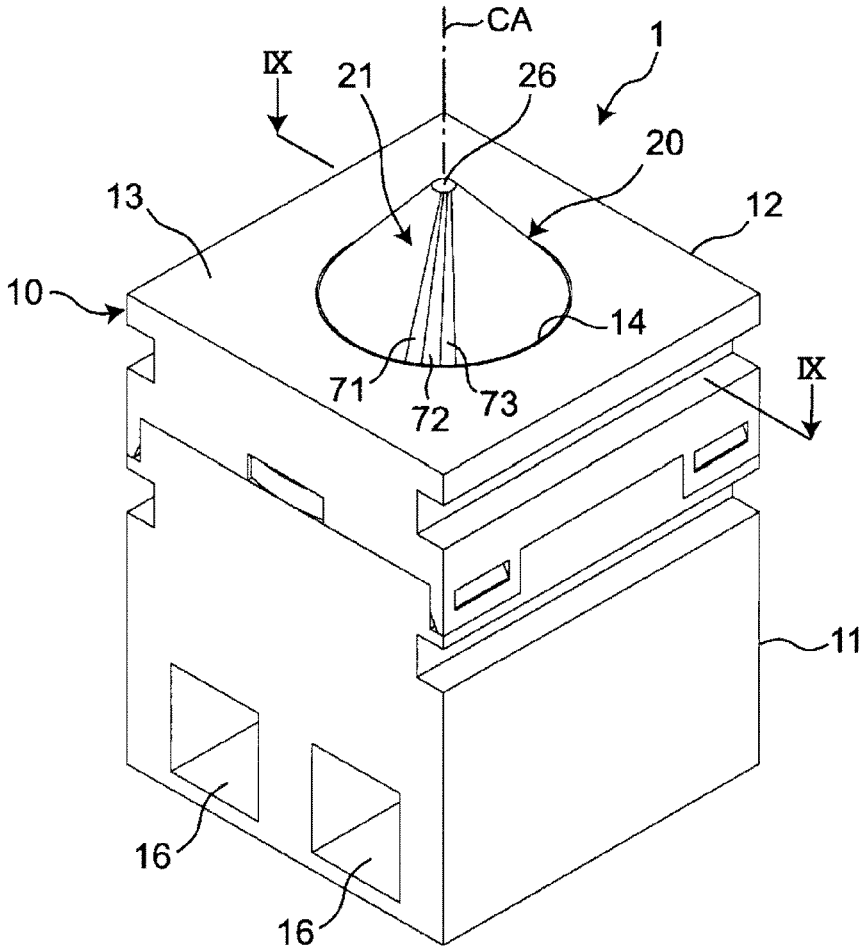
FIG. 7 is a perspective view of a switch according to a second modification of the switch in FIG. 1.
Figure 8:
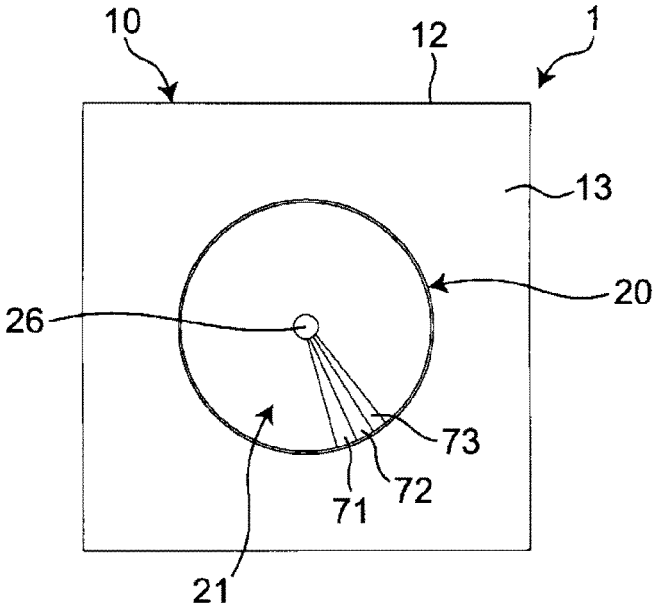
FIG. 8 is a plan view of the switch in FIG. 7.

As shown in FIGS. 7 and 8, for example, the operation part 21 may have more slopes (e.g., slopes 71, 72, and 73 shown in FIG. 7). In this case, the slopes 71, 72, and 73 are sectors each having a central angle of about 360/N degrees, where N is the total number of slopes. The N slopes define the outer surface of the operation part 21. Slopes (e.g., the slopes 71 and 73) adjacent to one slope (e.g., the slope 72) may be located within an angle of less than 180 degrees about the central axis CA with respect to that slope.

The operation part 21 may be at least a pyramid. Thus, the operation part 21 may be a cone having the multiple slopes 23, 24, and 25 as in the switch 1, or may be a pyramid having multiple pyramidal faces exposed outside the housing 10 and each serving as a slope. The shape of the operation part 21 may be changed as appropriate in accordance with, for example, the design of the switch 1. This increases the design freedom of the switch 1.

The slopes 23, 24, and 25 of the operation part 21 may not be sectors, and may be triangles. More specifically, the operation part 21 may be circular when viewed in the movement direction, or may be polygonal (e.g., triangular in the switch 1 in FIGS. 1 and 2 and pentagonal in the switch 1 in FIGS. 5 and 6) in accordance with the number of slopes.

Figure 9:
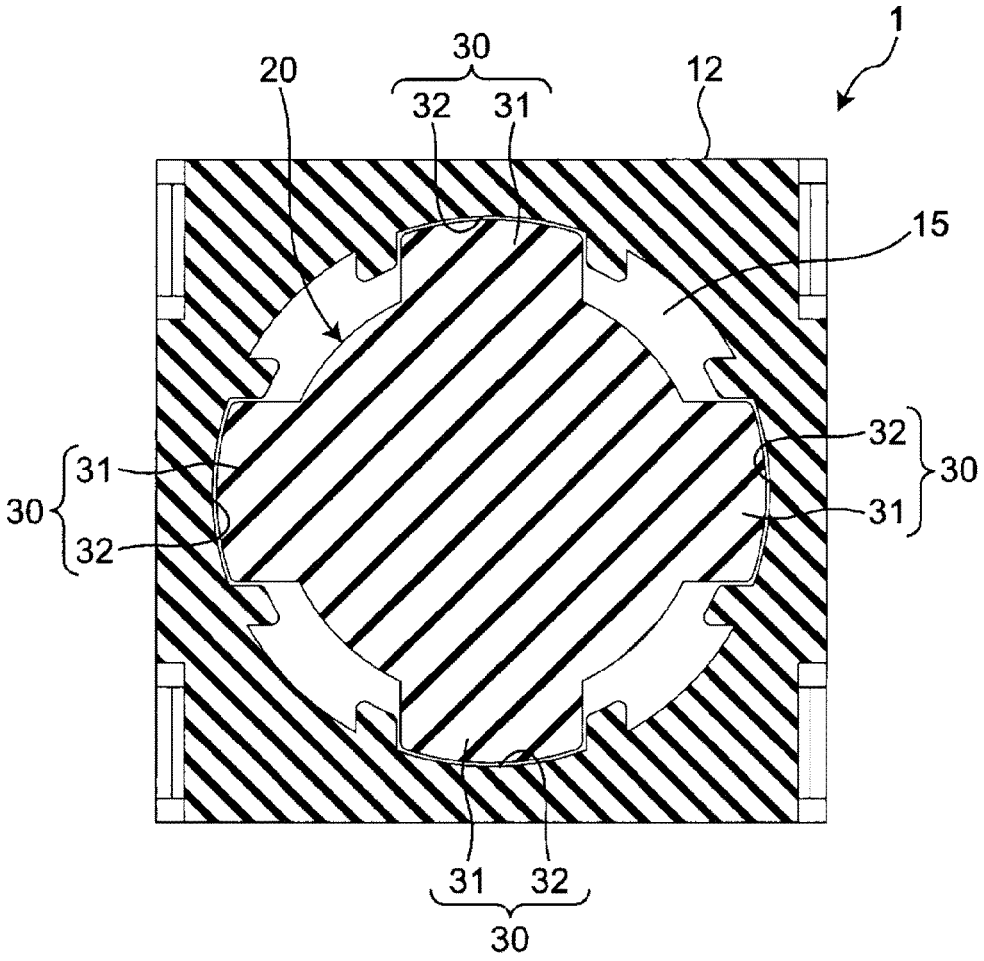
FIG. 9 is a cross-sectional view taken along line IX-IX in FIG. 7.

The guide 30 may be located on at least one side of the movable member 20 in the operational direction with respect to the movable member 20, rather than the two guides 30 on the two sides of the movable member 20 in the operational direction as in the above embodiment. Three or more guides 30 may be provided. FIG. 9 shows one example switch 1 including four guides 30.

The contact mechanism 40 may have any contact structure (e.g., sliding contact and butting contact).

The sealant 50, which is tubular and has openings at its two ends in the movement direction, may not be formed from an insulating resin such as rubber, and may be, for example, an O-ring or an X-ring. More specifically, the sealant 50 may be any sealant that seals the gap 52 between the movable member 20 and the housing 10 inside the compartment 15.

The embodiments of the present disclosure are described above in detail with reference to the drawings. The embodiments may be modified in various forms described below. The components below are given reference numerals in one example.

A switch 1 according to a first aspect of the present disclosure includes

- a housing 10 having an operation surface 13 with an operation hole 14 and an internal compartment 15 communicating with outside through the operation hole 14,
- a movable member 20 accommodated in the compartment 15 and extending in a movement direction intersecting with the operation surface 13 from the compartment 15 to outside the housing 10 though the operation hole 14, including an operation part located at an end of the movable member 20 outside the housing 10, and reciprocable in the movement direction relative to the housing 10, and
- a guide 30 that guides the movable member 20 in the movement direction.

The operation part 21 has a plurality of slopes 23, 24, and 25 extending linearly from the operation surface 13 toward a distal end 26 of the movable member 20 outside the housing 10, sloping away from a central axis CA extending in the movement direction of the movable member 20 toward the operation surface 13, and sloping in directions intersecting with one another as viewed in the movement direction.

In the switch 1 according to the first aspect, the movable member 20 includes the operation part 21 located at the end outside the housing 10, and is reciprocable in the movement direction relative to the housing 10. The operation part 21 has the plurality of slopes 23, 24, and 25 sloping away from the central axis CA of the movable member 20 toward the operation surface 13 and sloping in the directions intersecting with one another as viewed in the movement direction. The plurality of slopes 23, 24, and 25 allow the movable member 20 to be operable in multiple directions about the central axis CA. The switch 1 thus has a lower likelihood of the operational direction being limited.

In a switch 1 according to a second aspect of the present disclosure, the plurality of slopes include a first slope 23 and a second slope 24.

The second slope 24 is adjacent to the first slope 23 about the central axis CA, and is located within an angle of less than 180 degrees about the central axis CA with respect to the first slope 23.

The switch 1 according to the second aspect allows the movable member 20 to be operable in multiple directions about the central axis CA more reliably, and thus has a lower likelihood of the operational direction being limited.

In a switch 1 according to a third aspect of the present disclosure, the operation part 21 is a pyramid having the plurality of slopes being pyramidal faces.

The switch 1 according to the third aspect has higher design freedom.

A switch 1 according to a fourth aspect of the present disclosure includes the guide 30 including a protrusion 31 located on one of the housing 10 and the movable member 20, protruding in the operational direction intersecting with the movement direction, and being elongated in the movement direction, and a groove 32 extending on the other of the housing 10 and the movable member 20 in the movement direction and receiving the protrusion 31 to guide the received protrusion 31 in the movement direction.

In the switch 1 according to the fourth aspect, the guide 30 guides the movable member 20 in the movement direction more reliably. The switch 1 thus has higher operability.

A switch 1 according to a fifth aspect of the present disclosure further includes a sealant 50 sealing a gap 52 between the movable member 20 and the housing 10 inside the compartment 15.

In the switch 1 according to the fifth aspect, the sealant 50 protects a contact mechanism 40 from a fluid such as water entering the compartment 15 through the operation hole 14 in the operation surface 13.

The embodiments or modifications described above may be combined with one another to produce their advantageous effects. One or more embodiments may be combined with other embodiments, one or more modifications may be combined with other modifications, or one or more embodiments may be combined with one or more modifications. The features of different embodiments or different modifications may also be combined.

Although the present disclosure is fully described in relation to preferable embodiments with reference to the appended drawings, modifications or changes to the present disclosure are apparent to those skilled in the art. Such modifications or changes are intended to fall within the scope of the present disclosure defined by the appended claims unless departing therefrom.

INDUSTRIAL APPLICABILITY

The switch according to the embodiments of the present disclosure may be usable for an automobile.

REFERENCE NUMERALS

1 switch
10 housing
11 case
12 cover
13 operation surface
14 operation hole
15 internal compartment
16 through-hole
20 movable member
21 operation part
22 working surface
23, 24, 25 slope
26 distal end
30 guide
31 protrusion
32 groove
40 contact mechanism
41 terminal
50 sealant
51 flange
52 gap
61, 62, 63, 64, 65 slope
71, 72, 73 slope
CA central axis
CL1, CL2, CL3 center line

The invention claimed is:

1. A switch, comprising:

a housing comprising an operation surface with an operation hole and an internal compartment communicating with outside through the operation hole;

a movable member accommodated in the compartment and extending in a movement direction intersecting with the operation surface from the compartment to outside the housing through the operation hole, the movable member comprising an operation part located at an end of the movable member outside the housing, the movable member being reciprocable in the movement direction relative to the housing;

a sealant fitted with the movable member, the sealant sealing a gap between the movable member and the housing inside the compartment; and a guide configured to guide the movable member in the movement direction, wherein the operation part comprises at least three slopes or a cone extending linearly from the operation surface toward a distal end of the movable member outside the housing, sloping toward a central axis extending in the movement direction of the movable member away from the operation surface, and sloping in directions intersecting with one another at the central axis, as viewed in the movement direction, and the sealant is fitted along an entire periphery of the movable member about the central axis at a position located below, in the movement direction, a portion of the moveable member that contacts the housing around an inner periphery of the operation hole and seals an entire periphery of the movable member with an upper opening of the sealant.

2. The switch according to claim 1, wherein any two adjacent slopes of the at least three slopes are located within an angle of less than 180 degrees about the central axis with respect to each other.

3. The switch according to claim 2, wherein the guide comprises a protrusion located on one of the housing and the movable member, protruding in an operational direction intersecting with the movement direction, and being elongated in the movement direction, and a groove extending on the other of the housing and the movable member in the movement direction and receiving the protrusion to guide the received protrusion in the movement direction.

4. The switch according to claim 1, wherein the operation part comprises a pyramid comprising the at least three slopes as pyramidal faces.

5. The switch according to claim 1, wherein the guide comprises a protrusion located on one of the housing and the movable member, protruding in an operational direction intersecting with the movement direction, and being elongated in the movement direction, and a groove extending on the other of the housing and the movable member in the movement direction and receiving the protrusion to guide the received protrusion in the movement direction.

* * * * *